US005530313A

United States Patent [19]

Chiu

[11] Patent Number: 5,530,313

[45] Date of Patent: Jun. 25, 1996

[54] SPARK PLUG WITH COPPER CORED GROUND ELECTRODE AND A PROCESS OF WELDING THE ELECTRODE TO A SPARK PLUG SHELL

[75] Inventor: Randolph K. Chiu, Davison, Mich.

[73] Assignee: General Motors Corporation, Detroit, Mich.

[21] Appl. No.: 327,754

[22] Filed: Oct. 24, 1994

[51] Int. Cl.[6] ..... H01T 13/20

[52] U.S. Cl. ..... 313/141; 313/326; 313/311; 313/11.5; 219/78.01; 445/7

[58] Field of Search ..... 313/141, 142, 313/140, 326, 311, 11.5; 445/7; 219/78.01

[56] References Cited

U.S. PATENT DOCUMENTS

| | | | |
|---|---|---|---|
| 3,356,882 | 12/1967 | Hallaver | 313/141 |
| 3,656,092 | 4/1972 | Swengel, Sr. et al. | 439/730 |
| 4,351,095 | 9/1982 | Davies | 445/7 |
| 4,493,964 | 1/1985 | Shigemasa | 219/78.02 |
| 4,647,750 | 3/1987 | Mosbacher | 219/78.01 |
| 4,931,686 | 6/1990 | Oakley | 313/141 |
| 4,970,426 | 11/1990 | Bronchart | 313/141 |
| 5,017,826 | 5/1991 | Oshima et al. | 313/142 |
| 5,179,313 | 1/1993 | Eves et al. | 313/141 |
| 5,210,457 | 5/1993 | Oshima et al. | 313/11.5 |
| 5,395,273 | 3/1995 | Matsutani | 455/7 |

*Primary Examiner*—Donald J. Yusko
*Assistant Examiner*—Lawrence O. Richardson
*Attorney, Agent, or Firm*—Cary W. Brooks

[57] ABSTRACT

The present invention includes a spark plug with a copper cored ground electrode wherein the copper core has a cross-sectional area of about 1.6 $mm^2$ to about 3.0 $mm^2$ and the remainder of the electrode is made from a nickel alloy sheath. The open end copper cored ground electrode is resistance welded to the steel shell using a light welding force of about 100 lbs. coupled with a low welding energy to eliminate voids and embrittlement in the copper core adjacent to the weld interface.

13 Claims, 2 Drawing Sheets

SPARK PLUG WITH COPPER CORED GROUND ELECTRODE AND A PROCESS OF WELDING THE ELECTRODE TO A SPARK PLUG SHELL

This invention relates to a spark plug with a copper core ground electrode, and more particularly to a spark plug wherein the ground electrode has been resistance butt welded to a metal spark plug shell.

BACKGROUND OF THE INVENTION

Spark plugs have been known to include copper cored ground electrodes. However, welding such copper cored ground electrodes to spark plug shells made from metal such as steel have been problematic. U.S. Pat. No. 4,931,686 discloses spot welding a copper cored ground electrode to a side of the steel shell. U.S. Pat. No. 4,970,426 discloses welding a copper cored ground electrode to the end of the shell with the copper enclosed within the electrode sheath. This is because copper is an electrically high conductive material, making it difficult to resistance weld copper directly to steel without voids and embrittlement in the copper adjacent to the weld interface. To eliminate this void and embrittlement problem, U.S. Pat. No. 5,210,457 discloses inserting a second core of nickel alloy or iron within the copper cored ground electrode and welds that end to the shell. If the copper cored ground electrode has internal voids and embrittlement, it can break off easily. It also will hinder heat transfer and hence fail to keep its firing tip cool to retard erosion (wear) and to reduce the thermal stress on the platinum alloy firing tip.

The present invention overcomes many of the disadvantages of the prior art.

SUMMARY OF THE INVENTION

The present invention includes a spark plug with a copper cored ground electrode wherein the copper core has a substantial cross-sectional area relative to the total cross-sectional area of the electrode. The copper core is surrounded on the sides by a sheath made from a metal such as nickel-based alloy. The ground electrode has an open-end wherein both the copper core and sheath are exposed and are butt welded to the metal shell. When butt welded the open-end to the shell, the sheathing penetrates deep into the steel shell to provide an anchor for mechanical strength.

The invention also includes a process of butt welding a copper core ground electrode to the metal shell of a spark plug including the step of welding, such as resistance welding, with a relatively light force ranging from about 90 lbs. to about 150 lbs. depending on the size of the ground electrode. The ground electrode has an open-ended copper core. A light welding force is necessary to create a high contact resistance between the open end copper and the steel shell and to compensate for the highly electrical conductive copper core. A weld setting of lower energy can be used and yet a majority of this lower energy is utilized at the weld interface without causing internal voids and embrittlement adjacent to the weld interface of the copper cored ground electrode. The light welding force results in the metal sheath of the electrode being embedded deeply in the steel shell and with a substantial amount of the copper core ground electrode in areas bonded and in direct contact with the steel shell in a nonembrittled state.

These and other objects, features and advantages of the present invention will become apparent from the following brief description of the drawings, detailed description and appended claims and drawings.

DETAILED DESCRIPTION

Figure 1:
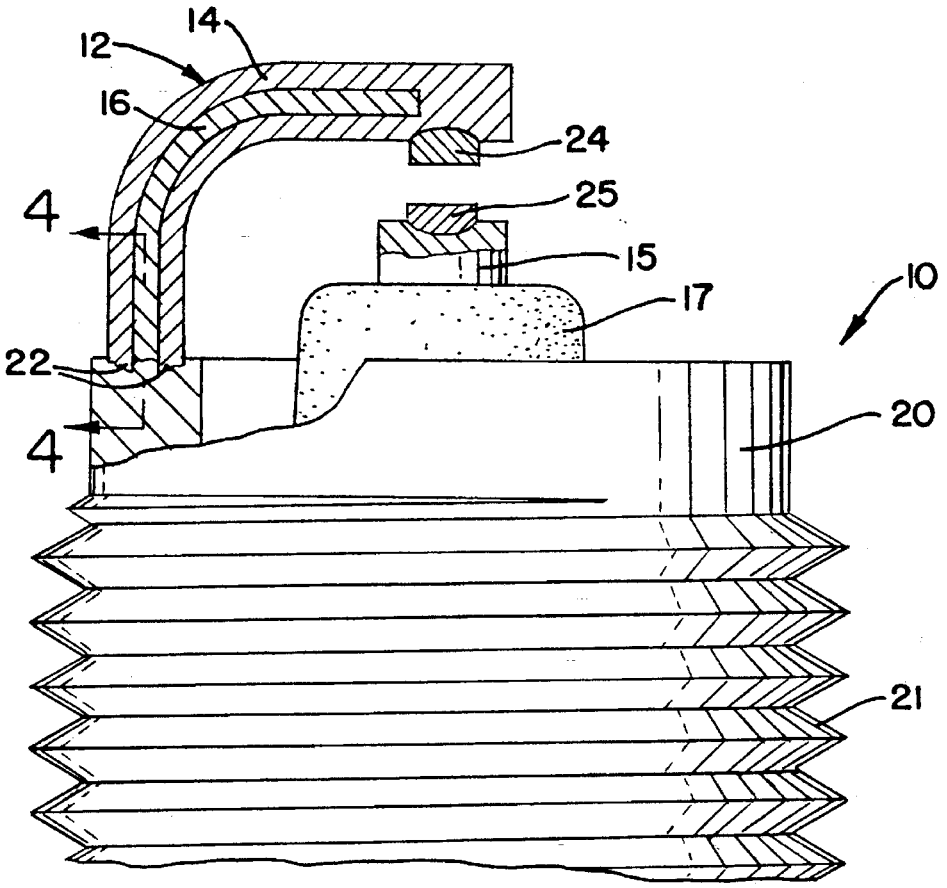
FIG. 1 illustrates a sectional view of a ground electrode used according to the present invention.

A spark plug 10 with ground electrode 12, and a center electrode 15 including a platinum tip 25. The center electrode 15 is surrounded by an insulator 17 and metal shell 20 with thread portion 21 according to the present invention is illustrated in FIG. 1. The ground electrode 12 includes a copper core 16 and a metal sheath 14 which may be made from a nickel-based material such as INCONEL 600 which is a nickel, chrome and iron alloy. The ground electrode 12 has an open copper end 23, that is, an end in which the copper core 16 is exposed. The copper core is relatively large, for example, for a ground electrode having a cross-sectional area of approximately 5.0 $mm^2$, the copper core has an area of about 2.7 $mm^2$ which is approximately 54 percent of the cross-sectional area of the electrode. The copper core may also have a cross-sectional area ranging from about 1.6 $mm^2$ to about 3.0 $mm^2$, and total cross-sectional area of the electrode may range from 3.5 $mm^2$ to about 5.3 $mm^2$. The open end of the copper core electrode is illustrated in FIG. 2.

Figure 2:
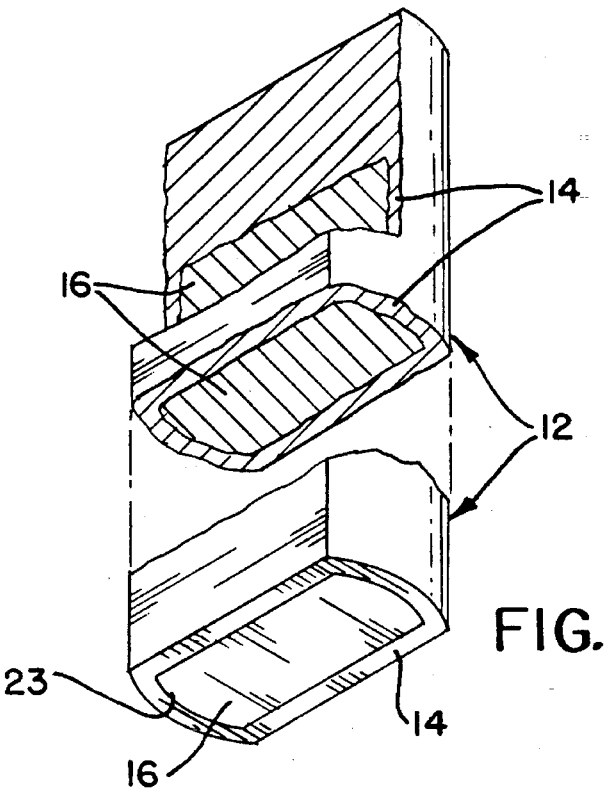
FIG. 2 is an enlarged end view with portion broken away of a ground electrode used according to the present invention.

According to the present invention a copper cored electrode as illustrated in FIGS. 1 and 2 is butt welded to a steel shell 20 of a spark plug. The butt welding is performed using a welding force ranging from about 90 to about 150 lbs. A preferred method of welding is resistance welding using a transformer with low output voltage, such as 3.0 to 4.5 volts.

Figure 4:
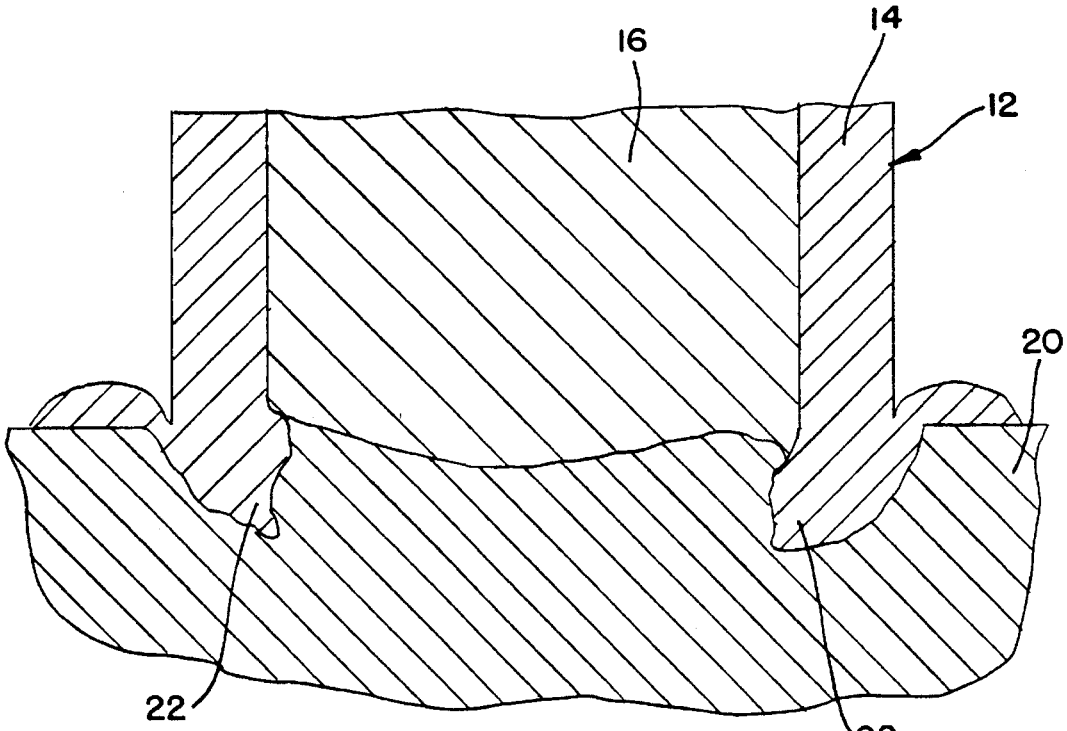
FIG. 4 is an enlarged view illustrating the characteristic of the weld made between a ground electrode and the metal shell of a spark plug according to the present invention.

According to the present invention a copper cored electrode was utilized having a cross-sectional area of approximately 5.0 $mm^2$ and a copper core area of 2.7 $mm^2$ or approximately 54 percent. The copper core was surrounded on the side by a metal sheath made from INCONEL 600. Electrodes with copper cores were welded with their open ends to metal shells using various number of welding cycles such as three, four, and five with various percentages of heat. Good welds were achieved using (a) a transformer output voltage of 4.0 volts, 5 alternating current (AC) cycles and about 28% heat (phase shift) and (b) a transformer output voltage of 3.5 volts, 3 or 4 cycles and 40 to 50% heat. A 100 lbs. welding force was used for all cases. The weld profile is illustrated in FIG. 4. The sheathing penetrated deep into the steel shell to provide an anchor 22 and to give the electrode bending strength which is particularly important when a spark plug gap is being formed. Preferably, the sheath 14 digs into the metal shell to a depth of about 0.3 mm deeper than the copper core does. The deep penetration of the sheath also provides better thermal conduction of heat from the ground electrode tip to the shell because the copper core is bonded and is in direct contact with the steel shell. When the electrode includes a platinum tip 24, the improved heat conduction or cooling of the ground electrode tip provides for longer service life due to reduced thermal stress associated with the mismatching thermal expansions of the platinum tip in the nickel based sheath material.

Figure 3:
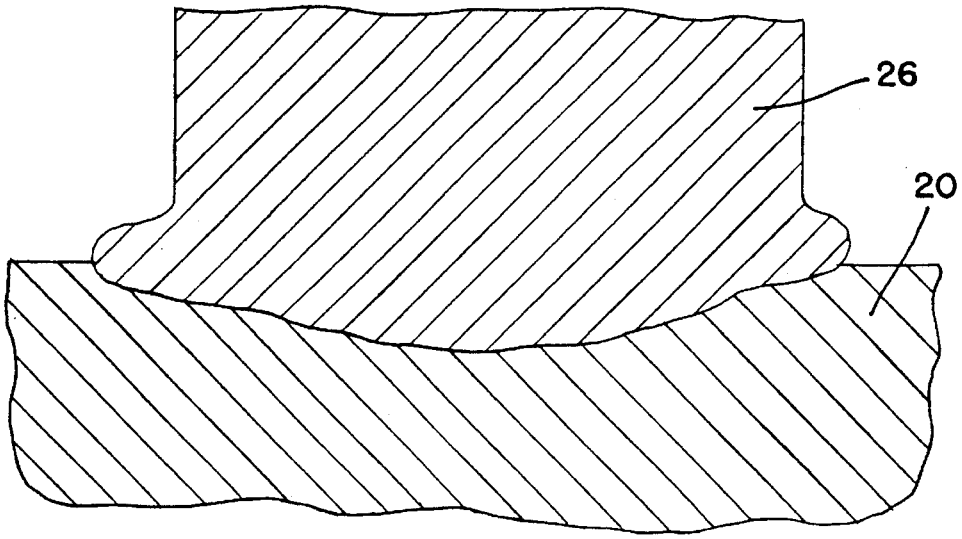
PRIOR ART FIG. 3
FIG. 3 illustrates the weld profile for high pressure welding of a conventional solid nickel based ground electrode to a metal shell.

In contrast to the present invention, the conventional solid nickel-based ground electrodes 26 are normally butt welded with a high welding force ranging from 220 to 300 lbs. The weld profile for such a process is illustrated in FIG. 3. The solid nickel ground electrode 26 did not penetrate the steel shell 20 of the spark plug as the copper cored sheath does per this invention.

The embodiments of the invention in which an exclusive property or privilege is claimed is defined as follows:

1. A method of welding a copper cored ground electrode to a metal shell of a spark plug comprising:

providing a metal shell having a flat surface extending perpendicular to a longitudinal axis of the spark plug, and an electrode having a metal sheath surrounding a single core consisting essentially of copper, said electrode having an open end which exposes the copper core and a closed end;

resistance butt welding the open end of the electrode to the flat surface of the metal shell under a welding force ranging from about 90 to about 150 pounds so that a portion of the metal sheath extends into the metal shell with the sheath penetrating deeper into the shell than the copper core to provide an anchor for the copper core.

2. A method as set forth in claim 1 wherein the electrode has an overall rectangular cross-sectional area ranging from 3.5 $mm^2$ to 5.3 $mm^2$.

3. A method as set forth in claim 1 wherein the copper core has a cross-sectional area ranging from 46% to 57% of electrode.

4. A method as set forth in claim 1 wherein the copper core also extends through the ground electrode approximately 2.0 mm to 3.0 mm from the closed end of the electrode.

5. A method as set forth in claim 1 wherein the electrode further comprises a firing tip end having a platinum alloy firing tip resistance welded to the electrode.

6. A method as set forth in claim 1 wherein said sheath penetrates about 0.3 mm deeper into the shell than the copper core.

7. A spark plug comprising:

a metal shell;

electrode having a metal sheath surrounding a single core consisting essentially of copper, said electrode being resistance welded to the metal shell so that the metal sheath penetrates deeper into the metal shell than the copper core to provide an anchor for the copper core.

8. A spark plug as set forth in claim 7 wherein the electrode has an overall rectangular cross-sectional area ranging from 3.5 $mm^2$ to 5.3 $mm^2$.

9. A spark plug as set forth in claim 7 wherein the copper core has a cross-sectional area ranging from 46% to 57% of electrode.

10. A spark plug as set forth in claim 7 wherein the copper core also extends through the ground electrode approximately 2.0 mm to 3.0 mm from the firing end of the electrode.

11. A spark plug as set forth in claim 7 wherein the electrode further comprises a firing tip end having a platinum alloy firing tip resistance welded to the electrode.

12. A spark plug as set forth in claim 7 wherein said sheath penetrates about 0.3 mm deeper into the shell than the copper core.

13. A spark plug as set forth in claim 7 further comprising a center electrode having a platinum alloy firing tip.

* * * * *